United States Patent [19]

Yanker

[11] 3,961,786

[45] June 8, 1976

[54] SELF CLEARING ROLLER FEED ASSEMBLY FOR DOCUMENT FEED APPARATUS

[75] Inventor: George Michael Yanker, Austin, Tex.

[73] Assignee: International Business Machines Corporation, Armonk, N.Y.

[22] Filed: June 23, 1975

[21] Appl. No.: 589,736

[52] U.S. Cl. ..... 271/122; 271/10; 271/258

[51] Int. Cl.[2] ..... B65H 3/06; B65H 5/06

[58] Field of Search ..... 271/DIG. 9, 10, 122, 271/125, 172, 233, 258

[56] References Cited

UNITED STATES PATENTS 2,892,629 6/1959 Osgood, Jr. et al. ..... 271/122

3,532,338 10/1970 Brinson et al. ..... 271/233

*Primary Examiner*—Evon C. Blunk
*Assistant Examiner*—Robert Saifer
*Attorney, Agent, or Firm*—John L. Jackson

[57] ABSTRACT

Disclosed is a rotatably powered roller feed assembly for transporting documents from a stack in a forward feed direction toward utilization apparatus, a clockspring appropriately coupled to the feed assembly for rotatably powering the feed rollers in a direction opposite to the feed direction of rotation in order to drive documents out of, and to therefore clear, the nip point of the roller assembly. The reverse rotation is initiated at the end of each feed cycle by control means, including an optical sensor assembly responsive to a document exiting the nip point, interrupting the powering of the roller assembly in the feed direction.

6 Claims, 4 Drawing Figures

SELF CLEARING ROLLER FEED ASSEMBLY FOR DOCUMENT FEED APPARATUS

Figure 1:
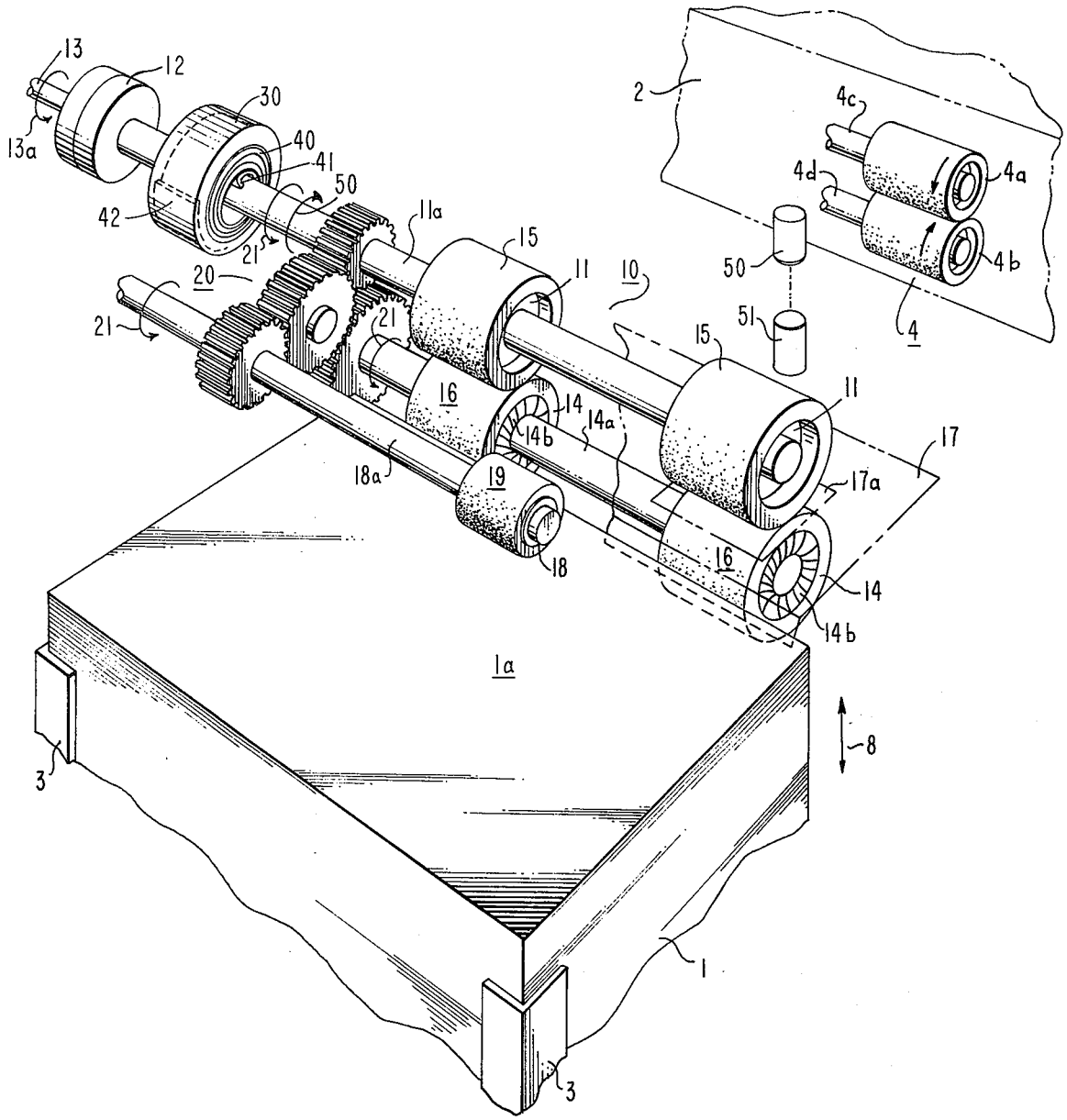

The present invention relates to document feeding, more particularly to document feed apparatus for feeding individual sheet-like documents from a stack, and even more particularly to means for assuring the clearance of documents from the nip point of the feed roller assembly of document feed apparatus after each feed cycle.

As used throughout the following description and the claims, the term "documents" means and refers to sheet-like articles, normally of a generally flexible nature; and would include, for example, paper, cards, envelopes, and the like.

In many applications, such as photocopying, data processing, card sorting, etc., it is necessary to separately feed individual documents to the particular utilization apparatus from a supply of said documents arranged in a stack. One of the conventional and known methods for effecting this feeding operation is by way of apparatus including a platform for supporting the stack of documents, a feeding mechanism comprising rotatably powered cooperating separator and restraint rollers positioned to receive documents fed from the top of the stack by a rotatably powered picker roller, and means for advancing the document support platform toward the feeding mechanism after depletion of a number of documents from the stack.

A sensor assembly is normally associated with the document feed apparatus to sense the trailing edge of each document passing through the nip point of the cooperating separator and restraint rollers and, in response to such sensing, disengage the means rotatably powering the feed rollers, at which time the separator, restraint, and picker rollers coast to a stop. The roller assembly is thereafter reactuated at the initiation of the next feed cycle.

While the aforementioned document feed apparatus has generally served its intended purpose, there is a principal disadvantage associated with its operation. Specifically, the time in which it takes for all of the rollers to coast to a stop at the end of each feed cycle enables one or more following sheets to be drawn from the stack into the separator-restraint roller nip point, particularly when the picker roller remains in driving engagement with the top of the document stack. Even if the picker roller is lifted from the stack at the termination of each feed cycle, the frictional and other forces acting upon the documents may still leave one or more documents within the separator-restraint roller assembly. While several attempts have been made to remedy this situation, including means to move either the restraint or separator rollers from engagement with one another to thereby open the nip points, such techniques have either been generally ineffective or excessively complex and expensive to implement.

It is therefore a principal object of the present invention to provide a new and improved method and apparatus for feeding documents.

It is another object of the invention to provide new and improved document feed apparatus of the aforementioned type for effectively feeding individual documents to utilization apparatus from the top of a stack of said documents.

It is a still further object of the invention to provide new and improved means for assuring the clearance of documents from the nip point of the feed roller assembly of document feed apparatus after each feed cycle.

In accordance with these and other objects, the present invention is directed to means for reversing the direction in which the documents are normally fed from the stack in response to, and subsequent to, each document passing through the separator-restraint roller assembly, thereby to drive following documents back to the stack and effectively clearing the nip point of the assembly after each feed cycle. More specifically, this reversal of feed is effected by a stored energy mechanism coupled with the separator roller shaft which incrementally rotatably powers the separator rollers in a direction of rotation opposite to that during normal feed, such reversal occurring in response to the detection of the trailing edge of the desired document being fed exiting the roller assembly.

Figure 2A:
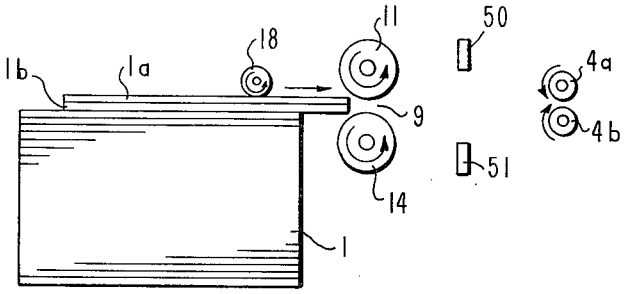
Figure 2B:
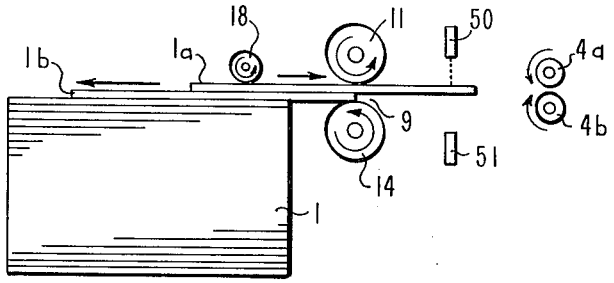
Figure 2C:
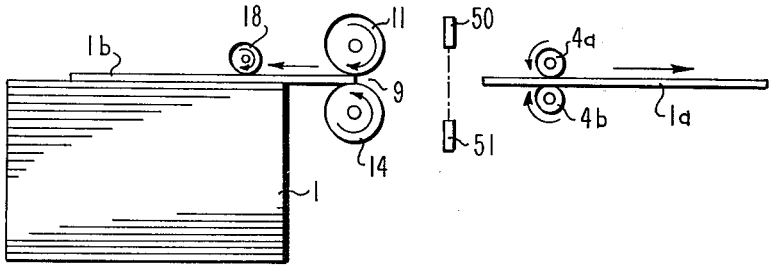

Additional features of the invention, as well as further objects and advantages thereof, will become more readily apparent from the following detailed description, taken in conjunction with the accompanying drawings in which:

FIG. 1 is a pictorial illustration illustrating the details of the pertinent portions of the document feed apparatus of the present invention, and its cooperative relationship with the documents to be selectively fed to utilization apparatus; and FIGS. 2A – 2C are diagrammatic representations illustrating the sequential operation of the apparatus illustrated in FIG. 1, and particularly the portion of the operation clearing the nip point of the feed assembly.

The drawings are not necessarily to scale and in some instances portions have been exaggerated in order to emphasize the features of the invention.

Referring initially to FIG. 1, the document feed apparatus of the present invention includes a document separating and feed roller assembly 10 for separately feeding documents from the top of a stack 1 to a pinch roller assembly 4 and thereafter to utilization apparatus, the housing of which is represented in phantom and generally designated by the reference numeral 2. As previously mentioned, the documents may be flexible sheets of paper, cards, envelopes, or like articles, the particular type of document depending upon the nature of the utilization apparatus 2. For example, the utilization apparatus may be one of a large variety of photocopying equipment in which event the stack of documents 1 would comprise blank sheets of copy material or suitably treated record medium. Alternatively, the documents may be checks, credit card receipts, or other commercial instruments bearing characteristic information indicia, the documents (and particularly the information on the documents) being suitably decoded, sorted, and processed by the apparatus 2.

The document stack 1 is normally contained within some type of a supply drawer or bin 3 and is supported at its base upon a vertically movable platform (not shown) effective to transport the stack in the direction of the arrow 8. The raising (and lowering) of the document support platform can be effected by any one of a number of automatic stack elevating mechanisms known in the art, the detailed construction and operation of such mechanisms and their motive means not being described herein since they form no part of the present invention.

The separator-feed assembly 10 includes one or more separator rollers 11 (two of which are shown in FIG. 1) spaced along, and mounted to rotate with, a rotatably driven shaft 11*a*. The separator shaft 11*a* is journaled for rotation in suitable bearings (not shown) and is adapted for operative coupling through a conventional clutch mechanism 12 with a drive shaft 13. The drive shaft 13 is continuously rotated in the direction of the arrow 13*a* by suitable drive means (not shown), such as an a-c motor; and, upon actuation of the clutch 12, rotatably powers shaft 11*a* in the same direction.

Located immediately below, and extending substantially parallel with, the separator shaft 11*a* is a shaft 14*a* journaled for rotation in suitable bearings (not shown), one or more restraint rollers 14 being longitudinally spaced along, and concentrically mounted with, the shaft 14*a*. The restraint rollers are coupled to shaft 14*a* by conventional clutch mechanisms 14*b* which are responsively operable to enable the restraint rollers to either rotate along with, and in the same rotatable direction of, the shaft 14*a*, or be freed from such rotation.

The restraint rollers 14 are positioned along the shaft 14*a*, and extend through openings 17*a* of a document guide plate 17 (shown in phantom and partially broken away for clarity of illustration), so as to be in operative communication with the separator rollers 11 at respective locations generally referred to as the "nip points." Specifically, the separator and restraint rollers have friction pads 15 and 16 disposed around their respective circumferences, which either rotatably bear against one another at the nip points or are separated from one another at the nip points by a slight clearance space approximately equal to the thickness of the document to be advanced therethrough.

Extending substantially parallel to shafts 11*a* and 14*a* is a third shaft 18*a* having a picker roller 18 mounted to rotate therewith. The picker roller shaft is journaled to rotate within an appropriate support structure (not shown), the support structure normally adapted to pivot the picker roller 18 into and out of engagement with the top of the document stack 1. The picker roller 18, having a circumferentially disposed friction pad 19 thereon, is effective, when rotatably engaging the document stack, to transport the top document 1a of the stack to the nip points of the restraint and separator rollers.

The shafts 11*a*, 14*a*, and 18*a* are appropriately interconnected, for example by way of a gear train 20, to simultaneously rotate in the same direction; and, upon the actuation of clutch 12 at the initiation of each feed cycle, the shafts will be powered in the direction of arrows 21. At such time, the clutch assemblies 14*b* are operable to rotate restraint rollers along with the rotation of shaft 14*a*. Thus, and as is apparent, the resulting rotation of picker roller 18 transports documents from the stack 1 to the nip points of the separator and restraint rollers; and the resulting counterrevolution between the separator and restraint rollers 11 and 14 advances the top document 1a toward the pinch roller assembly 4 and utilization apparatus 2, and tends to drive any underlying documents which may have been transported to the nip points back toward the stack.

To assist in the separate feeding of each document, the respective gear ratios of the gear train interconnecting the shafts 11*a*, 14*a*, and 18*a* are normally chosen so that, during the forward feed portion of the feed cycle, the separator rollers 11 have an angular velocity substantially greater than the angular velocity of the restraint rollers 14, and slightly greater than that of the picker roller 18. Additionally, and to further enhance separation, the coefficient of friction of the separator pads 15 is normally substantially greater than the coefficient of friction of the pads 16.

The pinch roller assembly 4 comprises a pair of cooperating rollers 4*a* and 4*b* which are respectively mounted to rotate with associated parallel extending shafts 4*c* and 4*d* journaled for rotation in suitable bearing supports. In a conventional manner, one of the shafts, say 4*c*, (and therefore roller 4*a*) is rotatably powered by drive means (not shown), the cooperating roller 4*b* therefore being rotated as a consequence of its frictional engagement with roller 4*a*. The rollers 4*a* and 4*b* rotate in the direction shown by the arrows thereon and are consequently effective to transport a document entering their nip point toward apparatus 2.

The nip point of the roller assembly 4 is suitably spaced from, and coplanarly aligned with, the nip points of the separator and restraint rollers 11 and 14 so that a document exiting the assembly 10 is gripped at its leading edge by the pinch roller assembly 4. Furthermore, and for the purpose subsequently described, the angular velocity of the rollers 4*a* and 4*b* is greater than the angular velocity of the separator rollers 11.

Concentrically disposed around, and rigidly mounted to prevent rotation with, the separator shaft 11*a* is a fixed hollow cylindrical housing 30. Disposed within the confines of the housing 30, and having one end 41 connected to shaft 11a, is a spiral spring 40 wound around the shaft 11*a* in a direction (clockwise in accordance with the viewing angle of FIG. 1) which, when wound by the rotation of the shaft in the direction of arrow 21, imparts torque to the shaft so as to tend to drive it in the opposite direction. The opposed end 42 of the spring 40 (which operates like a clockspring) is free to slide around the inner wall of housing 30 which not only limits the extent of torque imparted to the separator shaft, but also protects the spring from being overwound.

As is apparent, the rotation of the separator shaft 11*a* in the direction of arrow 21 will wind the clockspring 40; thereafter, when the disengagement of the clutch assembly 12 frees the shaft 11a from the powered shaft 13, the resulting stored energy of the wound clockspring rotates the shaft 11a in the reverse direction of arrow 50. As subsequently described in greater detail in connection with the overall operation of the present apparatus, the disengagement of the clutch 12 (and consequent release of shaft 11*a*) is effected after, and in response to, each top sheet 1*a* passing through the roller assembly 10, the spring-driven reverse rotation of the shaft 11*a* (and rollers 11) being effective to clear the nip points of the separator-restraint roller assembly of any underlying documents that may have advanced along with top document 1*a*. Furthermore, by designing the clockspring 40 to slip within the housing 30 after it is wound to a predetermined amount of torque, the degree of reverse rotation of the separator shaft can be limited to only that necessary to drive the underlying or following documents back out of the nip points; and the spring 40 is protected from overwinding in the event that excessively long documents are being fed or an excessively high feed rate prevents the spring from completely unwinding during each feed cycle.

Disposed between the roller assembly 10 and the pinch roller assembly 4 is a sensor assembly which, in cooperation with an appropriate electronic control system, disengages the clutch 12 in response to each top document 1a being transported through the nip points of the separator-restraint roller assembly. In accordance with a preferred embodiment, the sensor assembly is located immediately behind (downstream from) the nip points and may be an optical sensor comprising a light transmitting portion 50 and a light sensing portion 51 so disposed to allow documents exiting the assembly 10 to pass between portions 50 and 51. The optical sensor is thus adapted to detect whenever a gap appears between documents exiting the nip points toward utilization apparatus 2, the purpose of which will become more clear in connection with the subsequent detailed description of the overall operation of the subject apparatus.

Referring now to FIGS. 2A – 2C, the overall operation of the document feet apparatus, and particularly the clearance of the separator-restraint roller nip points, is described. Specifically, initiation of a feed cycle is effected by control circuitry which actuates clutch assembly 12, resulting in the simultaneous rotation of rollers 11, 14, and 18 in the feed direction illustrated in FIG. 2A. As a consequence, the top document 1*a* from the stack 1 (as well as underlying documents such as 1*b*) is advanced by picker roller 18 toward the nip point 9 between the separator and restraint rollers 11 and 14.

As the documents 1*a* and 1*b* reach the nip point 9 (FIG. 2B), the counter-revolution of rollers 11 and 14 advances the top document 1*a* toward the pinch rollers 4*a* and 4*b* while tending to drive the underlying document 1*b* back toward the top of the stack.

The document 1*a* continues to advance until its leading edge enters the nip point of rollers 4*a* and 4*b*. Due to the greater angular velocity of these rollers, as previously described, the document 1*a* is accelerated from the separator-restraint roller assembly, generating a gap between the trailing edge of document 1*a* and the leading edge of document 1*b* within the nip point 9. This gap is sensed by optical sensor portions 50 and 51 (as depicted in FIG. 2C), resulting in the immediate disengagement of clutch 12, the stored energy of the wound clockspring 40 then quickly reversing the direction of rotation of roller 11 to that shown in FIG. 2C. Since the clutch assemblies 14*b* are, at this time, effective to operatively disengage the restraint rollers 14 from rotatable coupling with shaft 14*a*, the free restraint rollers now function as idler rolls; and both sets of rollers 11 and 14 drive the underlying documents 1*b* back to their original position on the stack, the resulting momentum clearing the nip point 9 of all documents. Additionally, if the picker roller 18 is lowered to the stack at this time, its consequent rotation (the separator shaft 11*a* being gearably coupled with picker roll shaft 18*a*) will assist in returning the documents to the stack. Thereafter, the feed cycle can be repeated with the nip point 9 being cleared of all documents prior to each feed. It is believed apparent that the closer the optical sensor assembly is located to the nip point 9, the sooner the gap between documents 1*a* and 1*b* will be sensed, thus minimizing the degree of reverse rotation (and spring torque) necessary to clear the nip point of trailing documents.

As a modification of the previously described embodiment, it may be desirable to only gearably interconnect the separator and picker roller shafts 11*a* and 18*a* and prevent the rotation of restraint rollers 14 except during the reverse nip point clearing portion of the cycle. In such event, the rollers 14 serve as fixed or passive restraint pads during the forward feed portion of the cycle.

Various modifications of the disclosed embodiments, as well as alternate embodiments of the invention, may become apparent to one skilled in the art without departing from the spirit and scope of the present invention as defined by the appended claims.

What is claimed is:

1. Apparatus for feeding documents from the top of a stack of said documents, said apparatus composing:

a. a first roller assembly comprising separator and restraint rollers cooperatively communicating with one another at a nip point, and a picker roller translating documents from said stack toward said nip point, b. respective shafts associated with said separator, restraint, and picker rollers and mounted for rotation with said rollers;

c. means adapted to be coupled with said separator roller shaft for rotatably powering said separator roller in a feed direction, thereby to advance documents entering said nip point away from said stock, d. spring means coupled with said separator roller shaft for urging said separator roller in a direction of rotation opposite to said feed direction, the torque imparted to said separator roller increasing as said separator roller rotates in said feed direction, and e. sensor means responsive to documents exiting said nip point for uncoupling said rotatable powering means from said separator roller shaft, thereby to enable said separator roller to rotate in said opposite direction, whereby documents entering said nip point are driven back toward said stack.

2. The apparatus as defined by claim 1 wherein said spring means is disposed within the confines of a housing disposed about said separator roller shaft, one end of said spring means being connected with said separator roller shaft and the opposed end of said spring means being free to slide along the interior wall of the said housing.

3. The apparatus as defined by claim 1 further comprising a second roller assembly positioned to receive documents exiting the said nip point of the first roller assembly, said second roller assembly comprising a pair of cooperating rollers rotatably powered in a direction to transport documents away from said first roller assembly and having a velocity of rotation exceeding that of said separator roller.

4. The apparatus as defined by claim 3 wherein said sensor means is responsive to sense a gap between the trailing edge of a document disposed within said nip point.

5. The apparatus as defined by claim 1 further comprising means for preventing rotation of said restraint roller during the time that said separator roller is powered in said feed direction.

6. The apparatus as defined by claim 1 further comprising clutch means, when actuated, for coupling said rotatable powering means with said separator roller shaft; and means operatively disengaging said restraint roller from rotatable mounting with its associated shaft; said sensor means being responsive to deactivate said clutch means.

* * * * *